US005899554A

United States Patent [19]

Hsu

[11] Patent Number: 5,899,554

[45] Date of Patent: May 4, 1999

[54] WRENCH HAVING A LIGHT DEVICE

[76] Inventor: Gin Tzou Hsu, No. 62, Lane 455, Da Li Road, Da Li City, Taichung Hsien, Taiwan

[21] Appl. No.: 09/109,503

[22] Filed: Jul. 2, 1998

[51] Int. Cl.[6] ..... B25B 23/18

[52] U.S. Cl. ..... 362/119; 362/253

[58] Field of Search ..... 362/119, 120, 362/253

[56] References Cited

U.S. PATENT DOCUMENTS 5,477,434 12/1995 Reed ..... 362/119

5,733,034 3/1998 Jan ..... 362/119

*Primary Examiner*—Stephen Husar

[57] ABSTRACT

A wrench includes a handle having a chamber for receiving one or more batteries and having a socket for engaging with one or more light bulbs. A conductor has one end engaged with the case electrode of the battery and the other end to be actuated to engage with the center electrode of the battery. A cover is secured to the handle for supporting the socket and for allowing the light bulb to be easily engaged with the socket without disengaging the cover. A knob may actuate the conductor to engage with the center electrode of the battery.

8 Claims, 3 Drawing Sheets

WRENCH HAVING A LIGHT DEVICE

BACKGROUND OF THE INVENTION

1. Field of the Invention

The present invention relates to a wrench, and more particularly to a wrench having a light device.

2. Description of the Prior Art

Typical wrenches have no light device for lighting purposes, such that the wrenches may not be easily operated in the dark places.

The present invention has arisen to mitigate and/or obviate the afore-described disadvantages of the conventional wrenches.

SUMMARY OF THE INVENTION

The primary objective of the present invention is to provide a wrench having a light device for lighting purposes and for allowing the wrench to be operated during the night or in the dark places.

In accordance with one aspect of the invention, there is provided a wrench comprising a handle including a driving stem for driving fasteners and including a chamber formed therein and including a socket secured thereto, at least one battery secured in the chamber of the handle and including a center electrode and a case electrode, a light bulb engaged with the socket, a conductor including a first end having a bulge engaged with the case electrode of the battery and including a second end, and means for actuating the second end of the conductor to engage with the center electrode of the battery. The light bulb is energized by the battery when the second end of the conductor is actuated to engage with the center electrode of the battery.

The handle includes a cover secured thereto for enclosing the chamber, the cover includes an opening formed therein, the socket is secured to the cover and extended inward of the opening for engaging with the light bulb. The socket is tilted relative to the cover. The handle includes at least one stop extended inward of the chamber for engaging with and for positioning the socket in place.

A securing device is further provided for securing the conductor to the handle.

The actuating means includes a knob slidably engaged in the handle, the knob includes at least one leg for engaging with and for actuating the second end of the conductor to engage with the center electrode of the battery. The handle includes a pair of opposite flanges for defining a channel, the knob is slidably engaged with the channel. The leg of the knob includes a shoulder slidably receiving the flange of the handle for guiding the knob to slide relative to the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
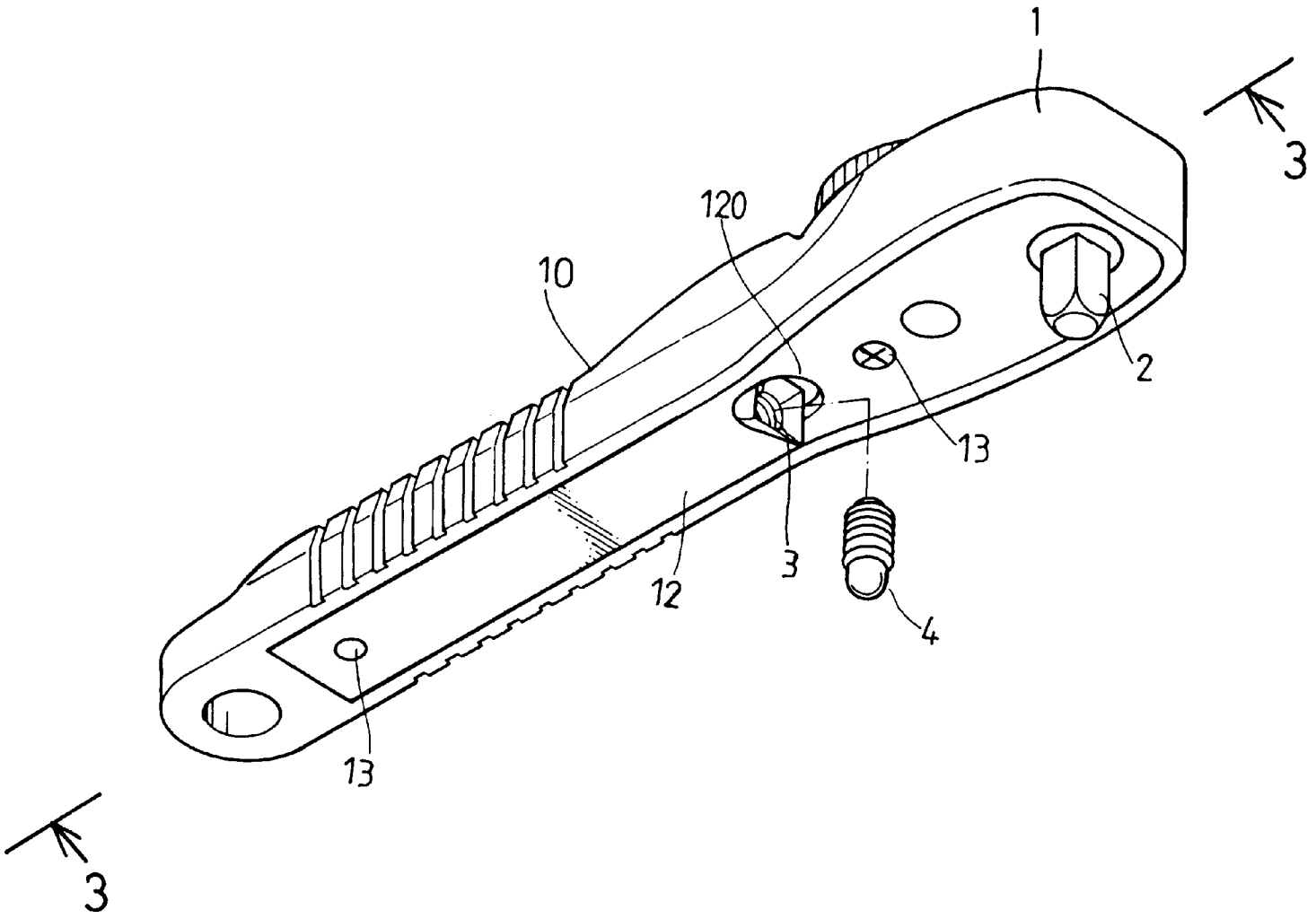
FIG. 1 is a perspective view of a wrench in accordance with the present invention.
Figure 2:
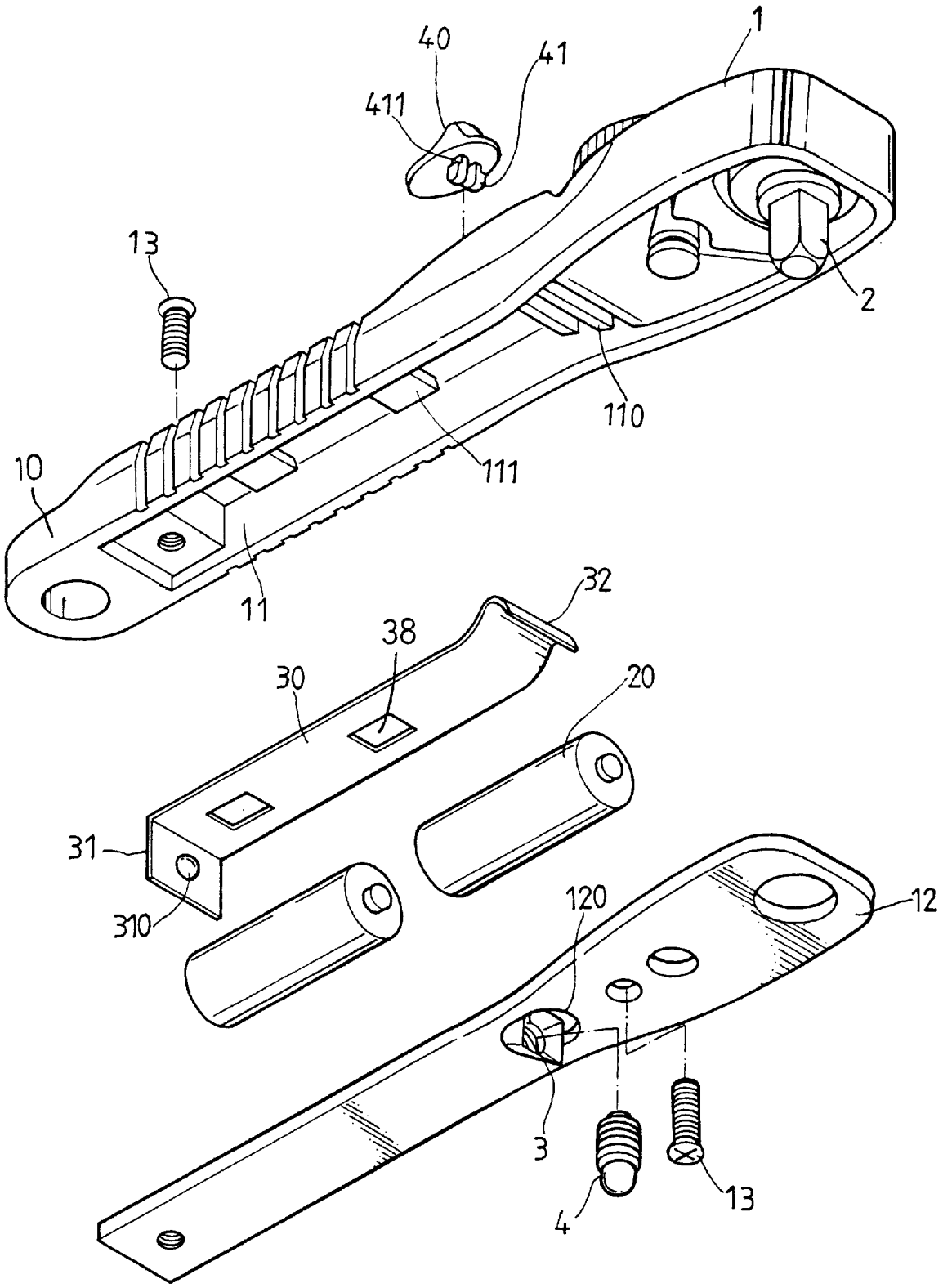
FIG. 2 is an exploded view of the wrench.
Figure 3:
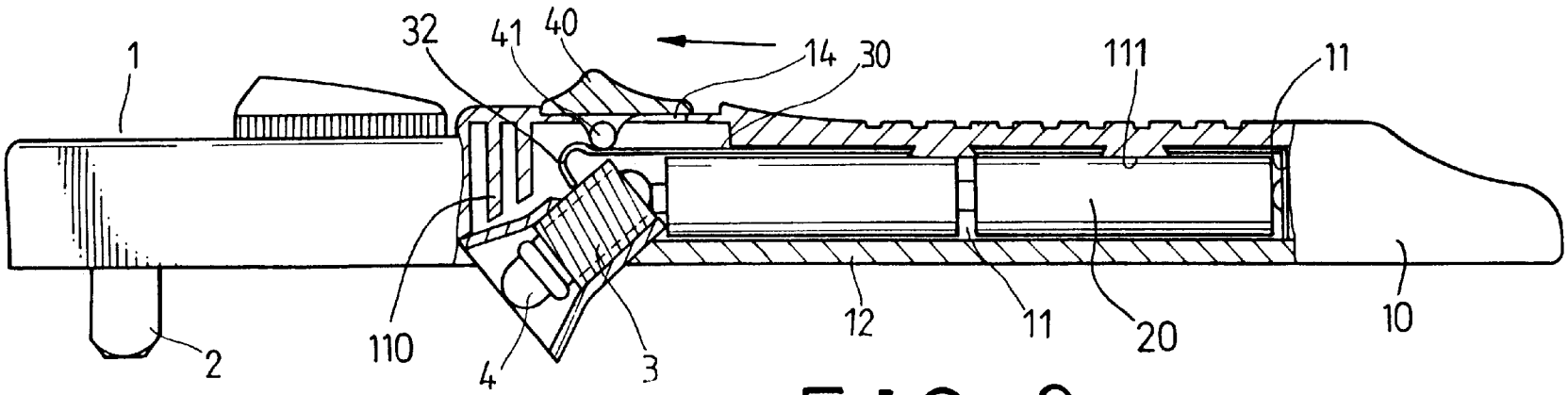
FIG. 3 is a cross sectional view taken along lines 3—3 of FIG. 1.

Referring to the drawings, and initially to FIGS. 1–3, a wrench in accordance with the present invention comprises a head 1 formed on one end of a handle 10 and having a driving stem 2 for engaging with and for driving an extension or a fastener. The handle 10 includes a chamber 11 formed therein and a cover 12 secured to the handle 10 with such as fasteners 13, for enclosing the chamber 11. The cover 12 includes an opening 120 and a socket 3 secured in the cover 12 and arranged in a tilted way relative to the cover 12 and extended inward of the opening 120 for engaging with a light bulb 4 or the like. The handle 10 includes one or more stops 110 extended inward of the chamber 11 for engaging with and for positioning the socket 3 in place (FIGS. 3, 4), and includes one or more projections 111 extended inward of the chamber 11.

Figure 4:
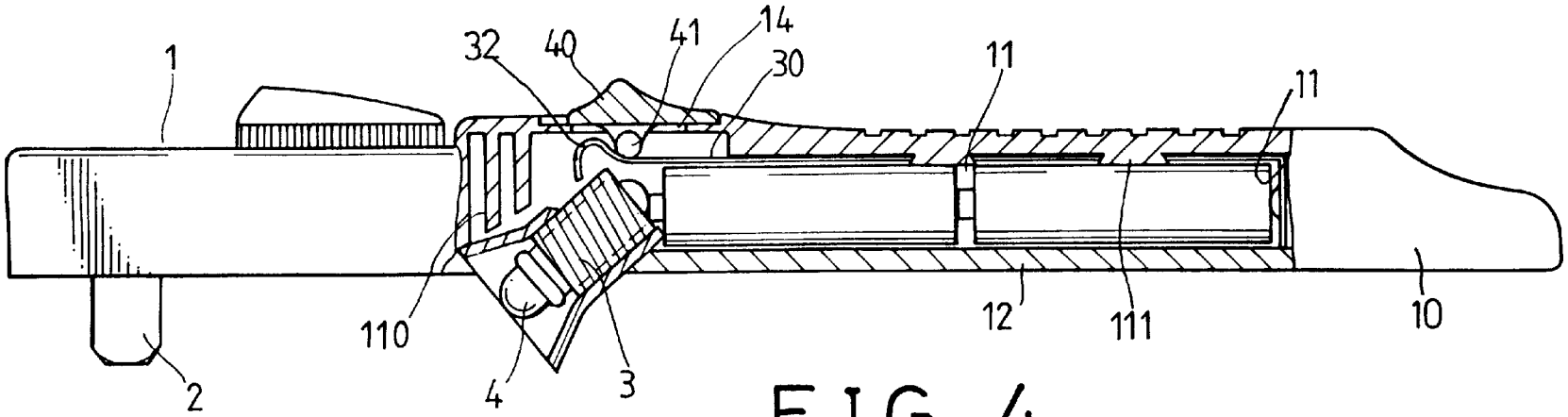
FIG. 4 is a cross sectional view similar to FIG. 3, illustrating the operation of the wrench.

A conductor 30 includes one or more orifices 38 for receiving the projections 111 and for positioning the conductor 30 in place within the chamber 11 of the handle 10, and includes one end 31 having a bulge 310 for engaging with the case electrode of one or more of the batteries 20, and includes the other end having a resilient member 32 adapted to be depressed to engage with the center electrode of the batteries 20 (FIGS. 3, 4). The batteries 20 are received in the chamber 11 of the handle 10. The handle 10 includes a channel (14) defined by a pair of opposite flanges 14 (FIGS. 3, 4). A knob 40 includes a pair of legs 41 extended through the channel (14) of the handle 10 and each having a shoulder 411 for slidably receiving the flanges 14 and for guiding the knob 40 to move forward and rearward along the channel (14). The provision of the shoulders 411 may increase the resilience of the legs 41 for allowing the legs 41 to be easily engaged through the flanges 14 and to slidably engage with the channel (14).

In operation, as shown in FIG. 4, the resilient member 32 of the conductor 30 has a tendency to be disengaged from the socket 3, such that the light bulb 4 may not be energized at this moment. As shown in FIG. 3, when the knob 40 is moved forward of the handle 10 to force the resilient member 32 to engage with the socket 3, the case electrode of the batteries 20 may be coupled to the light bulb 4 via the socket 3 so as to energize the light bulb 4, such that the light bulb 4 may be used for lighting the dark place while the wrench is in use.

It is to be noted that the socket 3 is preferably secured to the cover 12 and extended in the opening 120 for allowing the light bulb 4 to be easily engaged with the socket 3 without disengaging the cover 12 from the handle 10 and without disassembling the handle.

Accordingly, the wrench in accordance with the present invention includes a light device for lighting purposes and for allowing the wrench to be operated during the night or in the dark places.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench comprising:

a handle including a driving stem for driving fasteners and including a chamber formed therein and including a socket secured thereto, at least one battery secured in said chamber of said handle and including a center electrode and a case electrode, a light bulb engaged with said socket, a conductor including a first end having a bulge engaged with said case electrode of said at least one battery and including a second end, and means for actuating said second end of said conductor to engage with said center electrode of said at least one battery, said light bulb being energized by said at least one battery when said second end of said conductor is actuated to engage with said center electrode of said at least one battery.

2. The wrench according to claim 1, wherein said handle includes a cover secured thereto for enclosing said chamber, said cover includes an opening formed therein, said socket is secured to said cover and extended inward of said opening for engaging with said light bulb.

3. The wrench according to claim 2, wherein said socket is tilted relative to said cover.

4. The wrench according to claim 2, wherein said handle includes at least one stop extended inward of said chamber for engaging with and for positioning said socket in place.

5. The wrench according to claim 1, further comprising means for securing said conductor to said handle.

6. The wrench according to claim 1, wherein said actuating means includes a knob slidably engaged in said handle, said knob includes at least one leg for engaging with and for actuating said second end of said conductor to engage with said center electrode of said at least one battery.

7. The wrench according to claim 6, wherein said handle includes a pair of opposite flanges for defining a channel, said knob is slidably engaged with said channel.

8. The wrench according to claim 7, wherein said at least one leg of said knob includes a shoulder slidably receiving said flange of said handle for guiding said knob to slide relative to said handle.

* * * * *